US005105520A

United States Patent [19]

Eberle

[11] Patent Number: 5,105,520

[45] Date of Patent: Apr. 21, 1992

[54] METHOD OF USING A FLEXIBLE BAND CONTAINING HOOK AND LOOP FASTENER

[75] Inventor: Jürg Eberle, Hinwil, Switzerland

[73] Assignee: Ferag AG, Hinwil, Switzerland

[21] Appl. No.: 642,182

[22] Filed: Jan. 16, 1991

Related U.S. Application Data

[60] Division of Ser. No. 585,033, Sep. 17, 1990, which is a continuation of Ser. No. 251,794, Oct. 3, 1988, abandoned.

[30] Foreign Application Priority Data

Oct. 6, 1987 [CH] Switzerland ..... 3897/87

[51] Int. Cl.[5] ..... B23P 11/02

[52] U.S. Cl. ..... 29/450; 29/525.1

[58] Field of Search ..... 24/442, 443, 444, 445, 24/446, 306; 29/450, 525.1

[56] References Cited

U.S. PATENT DOCUMENTS 3,143,154 8/1964 Best .
3,279,008 10/1966 Wallach .
3,391,434 7/1968 Girard .
3,403,429 10/1968 Smith .
3,464,094 9/1969 Mates .
3,543,977 12/1970 Lockridge .
3,777,435 12/1973 Perina .
4,632,329 12/1986 Burley .

FOREIGN PATENT DOCUMENTS 2515855 11/1975 Fed. Rep. of Germany .
3520630 8/1985 Fed. Rep. of Germany .
8706091 4/1987 Fed. Rep. of Germany .
360592 10/1959 Switzerland .
1034837 6/1962 United Kingdom .

*Primary Examiner*—Timothy V. Eley
*Attorney, Agent, or Firm*—Bell, Seltzer, Park & Gibson

[57] ABSTRACT

The hook and loop fastener comprises a first fastener portion provided with a fastener pile containing hooks or both hooks and loops. This first fastener portion is intended to cooperate with a second fastener portion provided with a fastener pile which contains loops or both hooks and loops. To protect each of the fastener piles of the fastener portions from being excessively loaded under compression each of the fastener portions is provided with at least one compression-resistant spacer or distance member arranged alongside the associated fastener pile. The thickness of each such spacer or distance member amounts to at most the height of the related fastener pile, preferably is however slightly less than such fastener pile height.

16 Claims, 3 Drawing Sheets

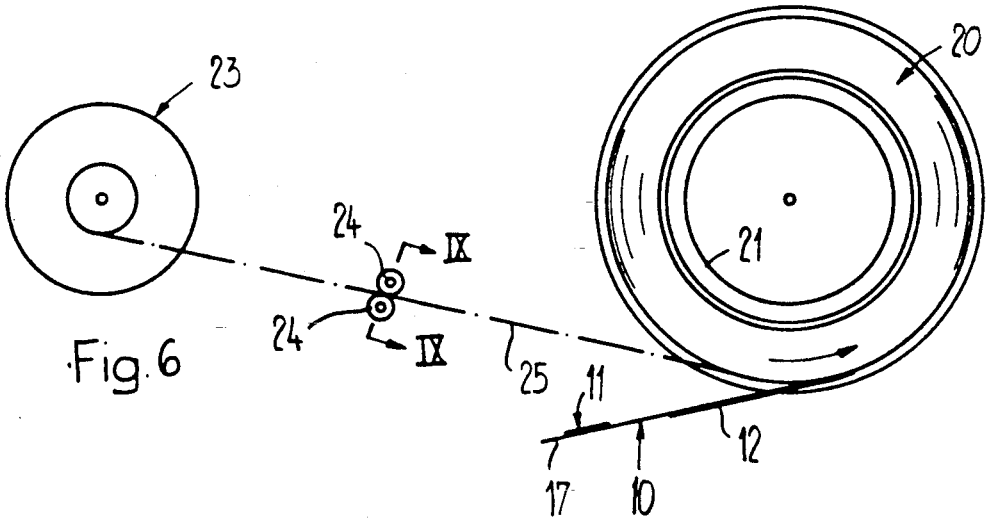
Fig. 6
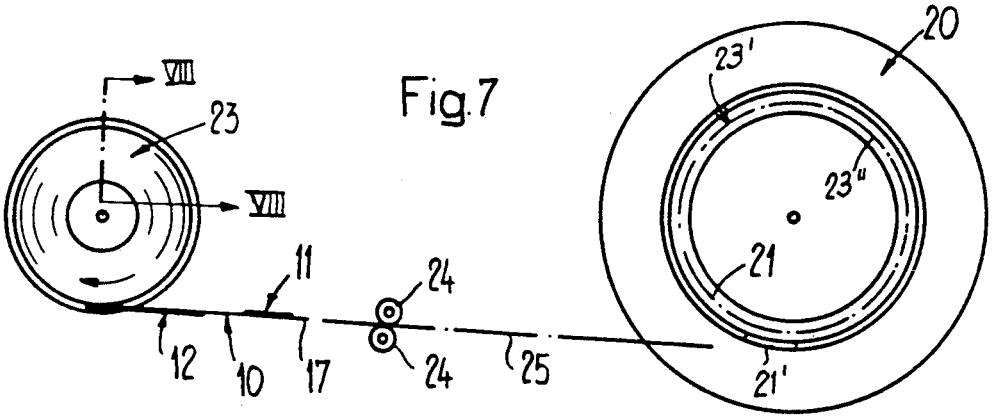
Fig. 7
Fig. 8
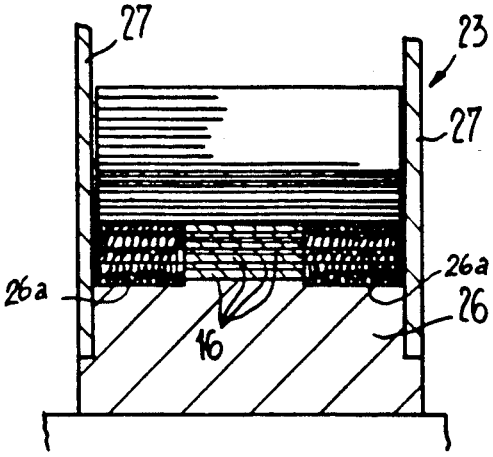
Fig. 9
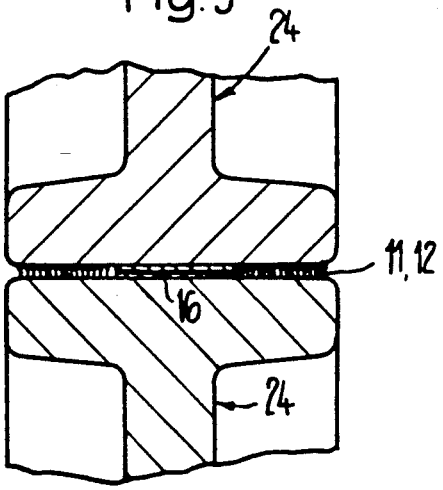

METHOD OF USING A FLEXIBLE BAND CONTAINING HOOK AND LOOP FASTENER

This application is a divisional of application Ser. No. 07/585,033, filed Sept. 17, 1990, which in turn is a continuation of application Ser. No. 07/251,794, filed Oct. 3, 1988, and now abandoned.

BACKGROUND OF THE INVENTION

The present invention relates to separable fasteners or fastening devices, in particular to hook and loop fasteners, a flexible band equipped with such fasteners and a method of using such flexible band.

In its more particular aspects, the hook and loop fastener or fastening device of the present development is of the type comprising a first fastener portion provided with a fastener pile, for instance a fastener pile containing hooks or both hooks and loops. This first fastener portion is intended to cooperate with a second fastener portion which is provided with a fastener pile which contains loops or both hooks and loops.

It is well known in the art of hook and loop fasteners or fastening devices that such contain two flat fastener or closure portions each of which comprises a fastener pile. When these two flat fastener portions are brought into contact with one another by exerting thereat a slight mutual pressure these two flat fastener portions adhere to one another. These mutually engaging fastener portions are capable of withstanding quite appreciable forces when such forces are applied approximately parallel to the surface of the fastener portions. Both of the fastener portions can be again separated from one another by tearing them apart in a direction away from one another by accomplishing a lifting motion of one of the fastener portions relative to the other.

There are basically two types of hook and loop fasteners which are known. One type, for instance which has become widely known in the art under the trademark "VELCRO" provides the one fastener portion with a fastener pile which exclusively consists of hooks and the other fastener portion comprises a fastener pile which exclusively consists of loops. The other type of hook and loop fasteners or fastener devices provide both the fastener portions with an associated fastener pile which contains both hooks and loops. It is here specifically noted that the fasteners or fastening devices of the present invention can be of the one or of the other aforementioned types of hook and loop fasteners.

With the prior art hook and loop fasteners the fastener pile of the fastener portions constitutes a relatively fragile or delicate element. In particular, the hooks composed of a monofilament can permanently deform when exposed to repeated and pronounced compressive loads, for instance when such fastener hooks are pressed against a hard support or surface. Also with time the loops of the loop-type fastener pile can be pressed flat against their associated base or foundation fabric. In both cases such so-to-speak "aging" phenomenon leads to the undesirable result that both of the fastener portions gradually no longer tend to reliably engage with one another, and thus, with time no longer afford any sufficient mutual attachment or interconnection to one another. The same also holds true in those situations where a hook and loop fastener, whose fastener portions engage with one another, are exposed to compressive overloading or excess loads throughout a longer period of time.

SUMMARY OF THE INVENTION

Therefore with the foregoing in mind it is primary object of the present invention to provide a new and improved construction of a hook and loop fastener as well as a flexible band or strap equipped with such hook and loop fastener, which are not afflicted with the aforementioned shortcomings or drawbacks of the prior art.

Another important object of the present invention aims at the provision of a new and improved method of using a flexible band or strap equipped with the novel construction of hook and loop fastener.

Still a further significant object of the present invention is directed to the provision of a new and improved construction of hook and loop fastener or fastening device which improves upon heretofore known hook and loop fasteners in that the fastener pile of both fastener portions of the hook and loop fastener, whether these fastener portions are in their separated or released state or in mutual fastening engagement with one another, are extensively protected against compressive overloading so that the fastener piles cannot become damaged.

Yet a further notable object of the present invention relates to a new and improved construction of a hook and loop fastener as well as a flexible band or strap equipped with such new and improved hook and loop fastener, wherein there is afforded extensive protection of the fastener piles of the hook and loop fastener, particularly protection against excessive compressive loading of the fastener piles of the hook and loop fastener so that such hook and loop fastener and the flexible band or strap equipped with the same can be repeatedly used over prolonged periods of time and in fields of application where such hook and loop fastener otherwise would have the fastener piles quickly damaged due to such compressive loading.

Yet a further appreciable object of the present invention is to devise a novel construction of hook and loop fastener provided with means for protecting the fastener piles against compressive loading so as to prolong both the longevity and to beneficially extend the field of use of such hook and loop fastener.

Now in order to implement these and still further objects of the invention, which will become more readily apparent as the description proceeds, the hook and loop fastener or fastening device of the present development, among other things, is manifested by the features that each of the fastener portions is provided with a spacer or distance member which is arranged alongside or adjacent the related fastener pile. The thickness or height of each such spacer or distance member at most amounts to the height of the associated fastener pile.

As alluded to above, the invention is not only concerned with the aforementioned novel construction of hook and loop fastener or fastening device, but further pertains to a flexible band or strap which is equipped with such novel hook and loop fastener. In its more particular aspects, this flexible band has opposed end regions and is provided at one of these end regions of such flexible band at one side or face thereof with one of the fastener portions. Spaced in the lengthwise or longitudinal direction of the flexible band there is provided at the other side or face of such flexible band the other of the fastener portions. The spacer or distance member of each of the fastener portions is flexible or pliant.

The invention also concerns a novel method of using such flexible band or strap in a winding apparatus for, for instance, winding-up substantially flat structures into a coiled product package upon a winding mandrel or winding-off or unwinding the coiled product package composed of the substantially flat structures. This flexible band or strap is used as a winding band or strap which is wound or coiled between the wound coils or layers of the substantially flat structures which are wound up upon the winding core to form a coiled product package or unwound from the coiled product package. This winding band or strap is releasably or detachably secured by means of the hook and loop fastener at the winding core or mandrel.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein:

FIG. 6 is a schematic side view of a winding or winder apparatus for substantially flat structures portraying the use of the flexible band or strap illustrated in FIG. 1 during winding-up of the substantially flat structures into a product package;

FIG. 7 is a view, similar to the showing of FIG. 6, of the winding or winder apparatus and depicting the use of such flexible band or strap as portrayed in FIG. 1 during the winding-off or unwinding of the substantially flat structures from a wound product package;

FIG. 8 illustrates in radial sectional view a portion of the winding band roll of the winding apparatus depicted in FIG. 7, taken substantially along the line VIII—VIII thereof;

FIG. 9 illustrates in sectional view a portion of the drive or guide rolls of the winding apparatus depicted in FIGS. 6 and 7 and specifically illustrating details of the gap or nip between such drive or guide rolls, the section being taken substantially along the line IX—IX of FIG. 6;

DETAILED DESCRIPTION OF THE PREFERRED EMBODIMENTS

Figure 1:
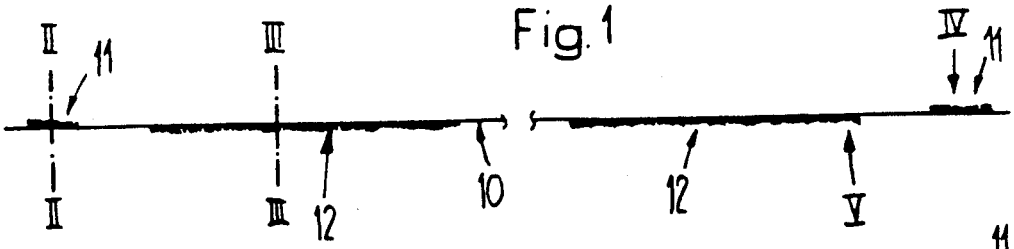
FIG. 1 illustrates in side view a flexible band or strap which is provided at its oppositely situated end or terminal regions with fastener or closure portions of a hook and loop fastener or fastening device constructed according to the invention.

Describing now the drawings, it is to be understood that to simplify the illustration of the drawings only enough of the construction of the winding apparatus for the winding-up of substantially flat structures into a coil product package and for unwinding the substantially flat structures from the coiled product package has been shown as needed to enable those skilled in the art to readily understand a possible field of use of the inventive flexible band or strap provided with the novel hook and loop fastener or fastening device. It is also to be expressly understood that although the invention will be described hereinafter in conjunction with a flexible band or strap and, specifically, a flexible band or strap which is used as a winding band for product packages formed of substantially flat structures, for instance printed products, such as newspapers, magazines, periodicals or the like, it should be clearly understood that the inventive hook and loop fastener or fastening device can be used in many other fields of application and particularly in those instances where also heretofore prior art constructions of hooks and loop fasteners have been employed. This is particularly inclusive of the garment or clothing industry including the footwear or shoe industry. Additionally, the inventive hook and loop fastener can be beneficially employed in further or other fields of application where heretofore that was not thought to be practical or possible, for instance for the releasable attachment of a tread sole to the inner sole of an article of footwear, such as a shoe or boot, or for the releasable attachment of a pedestal or socket of a heavy piece of equipment or apparatus at a predeterminate location or site. Further, it is to be observed, and as previously explained, that the invention also can be extended to such hook and loop fasteners or fastening devices wherein both fastener or closure portions contain the same type of fastener pile, namely a fastener pile which also contains both loops and equally hooks.

Turning attention now specifically to the exemplary embodiment of hook and loop fastener or fastening depicted in FIGS. 1 to 5 such will be seen to be affixed to a flexible band, strap or tape 10, for instance by being sewn or adhesively bonded therewith. Such hook and loop fastener comprises two fastener or closure portions 11 and 12 here shown to have an elongate configuration. The fastener portion 11 can be particularly well seen by referring to FIG. 2 and the fastener portion 12 by referring to FIG. 3. Each of the fastener or closure portions 12 and 13 possesses a base or substrate constituted, for instance, by a base or foundation fabric 13 which is provided with a related fastener pile. Specifically, in the exemplary embodiment under discussion the fastener portion 11 is provided, for example, with a hook pile 14 and the fastener portion 12 with a loop pile 15. It will be recalled, however, that each such fastener pile 14 and 15 can comprise both hook and loop elements, and by way of completeness it is also indicated that the hook pile, such as the hook pile 14 can be provided at the fastener portion 12 and the loop pile, such as the loop pile 15 can be provided at the fastener portion 11.

It is further to be noted, however, that the fastener piles 14 and 15 of both fastener or closure portions 12 and 13 do not occupy the entire width or crosswise extent of the associated base or foundation fabric 13, rather, in the exemplary embodiment under discussion, are divided into two strip-shaped fastener pile sections 14*a*, 14*b* and 15*a*, 15*b*, respectively, which here are shown to occupy the two marginal or edge regions of the associated base or foundation fabric 13 and which may possess the same pile section width, although such need not be so. From the illustration of FIGS. 2 and 3 it will be further recognized that between the fastener pile sections 14*a*, 14*b* and 15*a*, 15*b* there is secured a respective substantially strip or band-shaped spacer or distance member 16 upon the associated base or foundation fabric 13, for instance, by means of a suitable adhesive bond. Each such spacer or distance member 16 is formed of any suitable compression-resistant material and, specifically, for instance is fabricated from a sturdy or massive and flexible plastic band or strap. These spacer or distance members 16 may have the same width, although such is not absolutely necessary.

Figure 3:
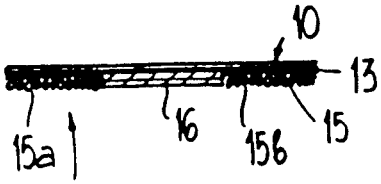
FIG. 3 illustrates on an enlarged scale a section of the hook and loop fastener depicted in FIG. 1, taken substantially along the line III—II thereof.
Figure 2:
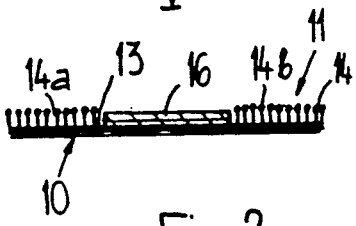
FIG. 2 illustrates on an enlarged scale a section of the hook and loop fastener depicted in FIG. 1, taken substantially along the line II—II thereof.
Figure 12:
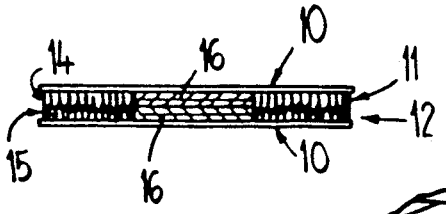
FIG. 12 is a fragmentary sectional view of a detail of the completely or fully wound product package shown in FIG. 10, taken substantially along the section line XII—XII thereof and depicting the end regions of the winding band or strap in order to demonstrate that the fastener portions provided with the fastener piles can sufficiently interengage or releasably interlock with one another not withstanding the presence of the spacer or distance members.

Continuing, and as will be further apparent from the illustration of FIGS. 2 and 3, each of the spacer or distance members 16 possesses a thickness or height which is advantageously slightly less than the thickness or height of the associated fastener pile 14 and 15. In the embodiment under discussion the thickness or height of each spacer or distance member 16 is less than the thickness or height of the related fastener pile 14 and 15 arranged alongside of or neighboring such spacer or distance member 16 by an amount which is sufficient in order to place into proper mutual engagement or releasable interlocking relationship the fastener piles 14 and 15 of both fastener portions 11 and 12, as also will be recognized by referring to FIG. 12.

In the arrangement of the hook and loop fastener or fastener device as depicted in FIG. 1 it will be seen that the fastener or closure portion 11, while leaving free a, for instance, rounded or curvilinear band tongue or end or end portion 17 (see also FIG. 4) is secured at the region of the end of the related flexible or pliant band or strap 10 at the one side or face thereof. On the other hand, the other fastener of closure portion 12 is secured at a spacing from the fastener or closure portion 11 at the other side or face of this flexible or pliant band or strap 10. In the embodiment under discussion the fastener portion 11 is also appreciably shorter than the other fastener portion 12, even though the drawing is not to scale. The reason for this construction and arrangement, as will be demonstrated more fully hereinafter, resides in the preferred exemplary field of use or application of this flexible band or strap 10.

Figure 4:
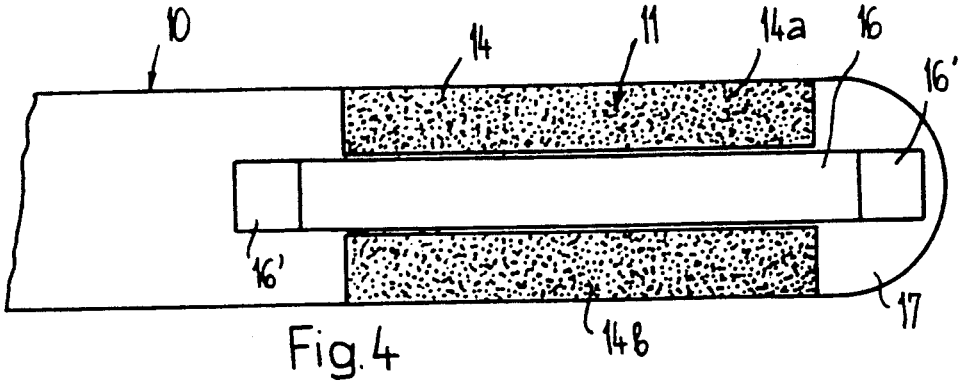
FIG. 4 is a fragmentary top plan view of the flexible band provided with the hook and loop fastener depicting one of the fastener or closure portions as viewed in the direction of the arrow IV in FIG. 1.
Figure 5:
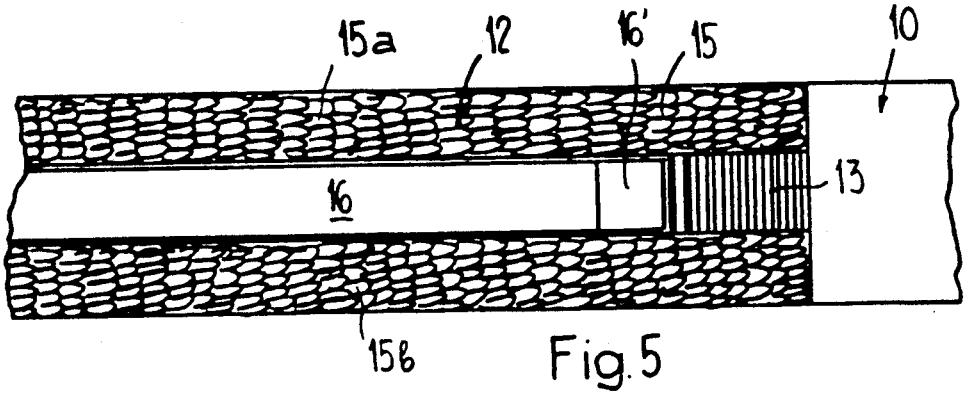
FIG. 5 is a fragmentary top plan view of the flexible band or strap of the arrangement depicted in FIG. 1 depicting the other fastener or closure portion as viewed in the direction of the arrow V in FIG. 1.

Additionally it is to be observed that at the fastener portion 11 the spacer or distance member 16 is longer than the related fastener pile sections 14*a*, 14*b* and protrudes at both ends past such fastener pile sections 14*a*, 14*b*. The end region 16' of this spacer or distance member 16, both as shown in the arrangement of FIG. 4 and also in the arrangement of FIG. 5, is bevelled or tapered, in other words, has a sloped configuration which comprises a continually decreasing thickness or height so that it does not terminate in a step-like structure or abrupt transition or step. As a result, the illustrated flexible or pliant band 10 together with the fastener portions 11 and 12 can be wound up, for instance, upon a supply spool without there being formed any appreciable irregularities or uneven band portions.

Turning attention now to FIG. 6, there will be recognized an only schematically depicted wound product package 20 formed of substantially flat structures or products which have been wound upon a winding core or mandrel 21 with the aid of the flexible band or strap 10 serving as a winding band or strap. These wound-up substantially flat structures or products have not been specifically identified in FIG. 6 but have been designated by reference numeral 22 in FIG. 13 and are wound up in an imbricated product formation. This flexible band or strap, hereinafter generally referred to as the winding band or strap 10 when used for winding substantially flat structures or products, is payed-off or delivered during the product winding up operation from a supply roll or spool 23 and is guided between a pair of rolls or rollers 24 to the product package 20, this pairs of rolls or rollers 24 here constituting a pair of coacting braked rolls. The travel path of the winding band 10 has been indicated with the chain-dot line 25.

In the illustrated state of the winding apparatus of FIG. 6 the product package 20 is assumed to be full and thus no further substantially flat structures or products are infed to the winding core or mandrel 21 and the products 22 which have already been wound up on the product package 20. Moreover, the winding band or strap 10 has already been wrapped at least one additional time about the formed product package 20. The fastener portion 12 is secured to the winding band or strap 10 at the side or face thereof which faces away from the wound product package 20 and has a length which exceeds the length of the circumference of the wound product package 20. On the other hand, the other fastener or closure portion 11 is secured at the other side or face of the winding band or strap 10 which confronts the wound product package 20, so that only the end of the winding band or strap 10 which is still visible in the showing of FIG. 6 must be placed upon the previously already wound up additional winding band coil or convolution and slightly pressed thereagainst. In this way the entire wound product package 20 is reliably fixed against undesirable unravelling or falling apart.

An analogous operation occurs during unwinding or winding-off of the substantially flat structures or products from the wound product package 20 as shown in FIG. 7. It will be understood that the winding band or strap 10 is again guided between the rolls or rollers 24 and payed off or withdrawn from the wound product package 20 and now is wound up upon the driven supply roll or spool 23. Also in this case the end of the winding band or strap 10 which previously was secured to the winding core or mandrel 21 is now itself fixed to the full supply roll or spool 23 for the winding band or strap 10.

From the sectional view depicted in FIG. 8 there will be recognized that the core or core member 26 of the supply roll or roller 23 is somewhat stepped at the regions 26*a* bounding the side flanges or flange members 27, in order to relieve the fastener pile sections, which come to bear directly upon the core or core member 26 upon winding the winding band or strap 10 upon the supply roll 23, completely from the pressure of the following coils or windings. As to the windings or coils or convolutions which follow the first winding or coil or convolution such are constituted by the spacer or distance members 16 which come to bear directly upon one another and which extensively relieve the adjacently situated fastener pile sections from the pressure or compressive forces exerted by the remaining windings or coils or convolutions of the winding band or strap 10.

By referring to FIG. 9 it will be apparent that when the winding band or strap 10 passes between the rolls or rollers 24 with one of the fastener portions 11 or 12, such fastener portions are extensively relieved of the compressive load or action which prevails in the roll gap or nip between such rolls 24, since this compressive action is absorbed or taken up by the spacer or distance members 16.

Instead of providing a remotely located supply roll or roller 23 for the winding band or strap 10 it would be possible to integrate the supply roll or roller, as generally indicated by reference character 23', in the form of a spool body 23" within the winding core or mandrel 21 in a manner known to the art from, for instance, the commonly assigned U.S. Pat. No. 4,532,750, granted Aug. 6, 1985, and also from the commonly assigned copending U.S. application 07/162,949, filed Mar. 2, 1988, and entitled "Package Support Device for the Intermediate Storage of Wound-Up Printed Products, such as Newspapers, Periodicals and the like", to which reference may be readily had and the disclosures of which are incorporated herein by reference. The spool body 23" of the supply roll or roller 23' may be arranged coaxially with respect to the winding core or mandrel 21 or axially parallel thereto and the winding core or mandrel 21 has an opening, generally represented by reference character 21', which may be closed by a cover, and through which there extends the winding band or strap 10.

The winding band or strap 10 can be releasably connected by means of the hook and loop fastener at the related winding core or mandrel, namely at the winding core or mandrel 21 at which there is wound up or unwound the product package 20 or at the winding core or mandrel of the internally located supply roll or roller 23', as the case may be. There may be then secured or positioned at the package winding core 21 or at the winding core of the internally located supply roll or roller 23' one of the fastener portions 11 located at an end region of the winding band or strap 10 and at a side of such winding band or strap 10 which confronts such winding core and which is situated in close proximity to the winding core there is located the other of the fastener portions 12 which is then secured to the one fastener portion 11. In so doing, the end region of the winding band or strap 10 which is located in close proximity to the winding core may be wrapped a number of times about the winding core and such winding band or strap 10 is then secured to itself by means of the hook and loop fastener.

Figure 10:
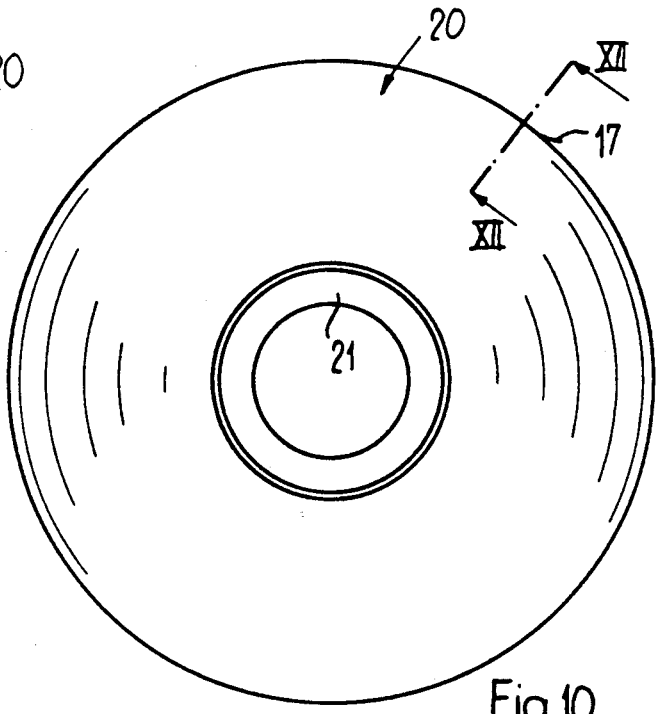
FIG. 10 is a side view depicting a complete or fully wound product package composed of wound-up substantially flat structures and secured or releasably lockingly retained by the flexible band or strap provided with the hook and loop fastener portions as shown for the arrangement of FIG. 1.

FIG. 10 illustrates in side view a wound product package 20 which has been fixed or held together by means of the associated winding band or strap 10. It will be seen that the band tongue or end portion 17 located at the end of the winding band or strap 10 which is disposed remote from the winding core or mandrel 21 has been reinforced or stiffened by the extension or end portion 16' of the spacer or distance member 16 which protrudes beyond the fastener or closure portion 11 (see also FIG. 4), and thus, outwardly depends or protrudes from the outer surface of the wound product package 20. Consequently, the band tongue or tongue portion 17 forms a convenient manipulating facility or tab which facilitates separation or detachment of the fastener portions 11 and 12 from one another.

Figure 11:
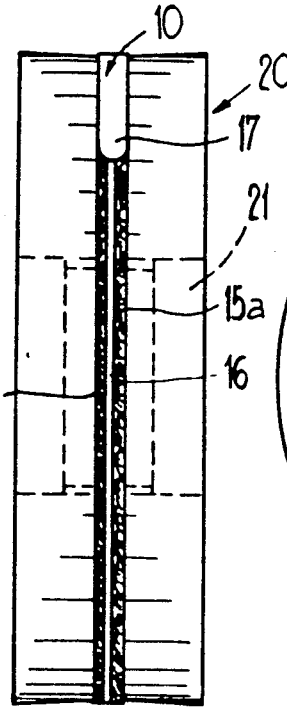
FIG. 11 is a front view of the product package depicted in FIG. 10 illustrating such product package provided with a winding band or strap constructed according to the invention and with the product package securely fixed against unravelling by means of such winding band or strap.

From the front view of the wound product package 20 as depicted in FIG. 11, it will be observed that the length of the fastener pile sections 15*a* and 15*b* of the fastener portion 12 (see also FIG. 5) considerably exceeds the length of the not particularly visible coacting fastener or closure portion 11. A part of the fastener pile sections 15*a* and 15*b* are thus freely accessible from the outside. However, even if the wound product package 20 is supported at its circumference or outer surface at the floor or other support structure or is rolled along such floor or support structure, these fastener pile sections 15*a* and 15*b* are not damaged because the here intermediately arranged spacer or distance members 16 extensively protect the fastener pile sections 15*a* and 15*b* from the compressive loads exerted by the inherent weight of the wound product package 20.

Figure 13:
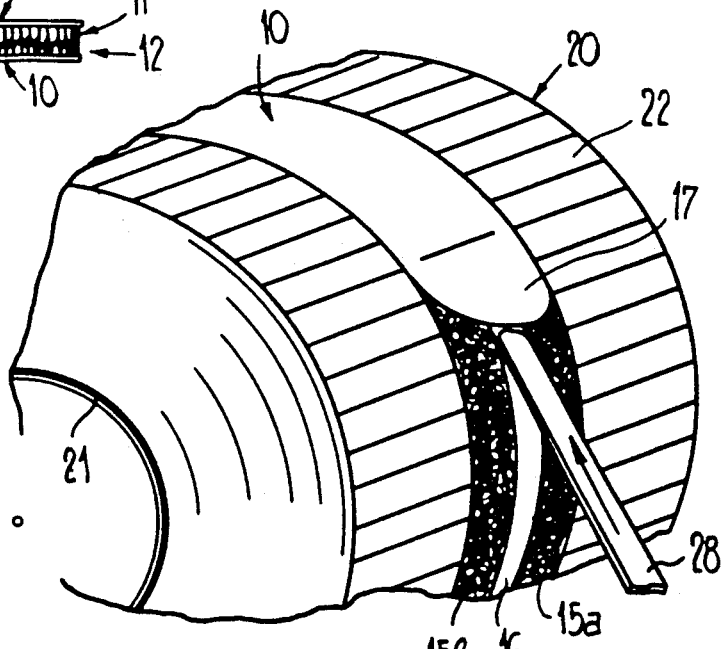
FIG. 13 is perspective view of the outer side or external region of the completely wound product package as shown in FIG. 10 and illustrated at that location where there is located the end of the winding band or strap.

Finally, from the showing of FIG. 13 there will be recognized a further advantageous characteristic of the here exemplary described winding band or strap and the spacer or distance members 16 which are provided between the fastener pile sections 15*a* and 15*b* and the fastener pile sections 14*a* and 14*b*.

The spacer or distance members 16 which, in the present exemplary embodiment and as previously explained, are formed of a massive or sturdy however flexible or pliant plastic band or strap member and are provided at their ends or end regions 16' (compare also FIGS. 4 and 5) with a continually decreasing thickness, thus form an ideal reception facility for the insertion or introduction of a flat, spatula-like or knife-like tool 28 by means of which there can be advantageously initiated the operation of separating or releasing the hook and loop fastener without damage to the fastener pile sections.

Although in the described exemplary embodiment the fastener or closure portion 12 provided, for instance, with the loop pile sections 15*a* and 15*b* is longer than the fastener or closure portion 11 provided with the hook pile sections 14*a* and 14*b*, it is of course also possible to make both fastener or closure portions 11 and 12 of the same length, or, as previously indicated, to equip the fastener or closure portion 11 with the loop pile and the other fastener or closure portion 12 with the hook pile.

Also the arrangement of each of the spacer or distance members 16 is accommodated in the described example to the intended field of application. Yet, for the same field of application or use it would also be possible to secure two spacer or distance members or strips at the marginal or edge regions of the flexible band or strap 10 and to occupy the intermediate space between such mutually spaced spacer or distance members with a single fastener pile section. In this connection it need only be conceptually visualized that in the arrangement of, for instance, FIG. 12 the elements 16 then constitute the coacting fastener portions provided with the fastener piles and the there laterally situated fastener portions 11 and 12 then constitute spacer or distance members which straddle the intermediately situated fastener portions.

In the event that the fastener portions of the proposed hook and loop fasteners should have imparted thereto a form or shape which deviates from an elongated form or shape, owing to the contemplated field of application, then of course the form or shape of the associated spacer or distance members and the fastener pile sections must be appropriately accommodated to such field of application. If, for instance, both of the fastener or closure portions are of the same size, and possess a circular or quadratic configuration and should be anchored to a fixed planar or flat substrate, then it is advantageous to provide at the marginal regions along the entire circumference of the fastener portion a strip defining the spacer or distance member which, if desired, can be augmented at the central region by a further spacer or distance member, whereas the surface which is left free of the circumferential spacer or distance strips is then occupied with one or a plurality of fastener pile sections.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A method of using a flexible band provided with a hook and loop fastener, said hook and loop fastener comprising a first fastener portion provided with a fastener pile, a second fastener portion provided with a fastener pile, said first and second fastener portions providing a separable fastening connection therebetween by means of said fastener piles, compression-resistant spacer means provided for each fastener portion and arranged adjacent the fastener pile of each said fastener portion, each of said spacer means having a predetermined thickness, each of said fastener piles having a predetermined height, the predetermined thickness of each of said spacer means at most corresponding to the predetermined height of the fastener pile of the associated fastener portion, said flexible band having a lengthwise direction, opposed end regions and opposite sides, one of said fastener portions being secured at one of the end regions of said flexible band at one side thereof, the other of said fastener portions being spaced in the lengthwise direction of the flexible band at said one of said end regions and being secured at the other side of said flexible band, further fastener portions secured at the other end region of the flexible band at opposite sides thereof and in spaced relationship from one another, said further fastener portions being provided with compression-resistant spacer means, said compression-resistant spacer means of each of said fastener portions and said further fastener portions comprising flexible spacer means, said method comprising the steps of:

employing said flexible band as a winding band which is would between winding coils of substantially flat structures which are to be wound up upon a winding core to form a product package from which the flexible band and the flat structures are unwound; and releasably connecting the winding band by means of the hook and loop fastener at the winding core.

2. The method as defined in claim 1, further including the steps of:

wrapping the end region of the winding band which is located in close proximity to the winding core at least once about said winding core and securing said winding band to itself by means of the hook and loop fastener.

3. The method as defined in claim 1, wherein:

an end region of the winding band located remote from the winding core carries at a side of the winding band which confronts the winding core one of the further fastener portions and in spaced relationship therefrom at the side of the winding band which faces away from the winding core the other one of the further fastener portions, so that the winding band after accomplishing at least one additional wrapping about the wound product package is fixedly releasably secured to itself about the wound product package.

4. The method as defined in claim 3, further including the steps of:

applying a substantially flat tool at an end of the winding band located remote from the winding core;

said substantially flat tool being applied between mutually contacting spacer means of the further fastener portions; and moving in relation to one another the tool and an outer surface of the wound product package in a predetermined product unwinding direction in order to release the further fastener portions from engagement with one another.

5. The method as defined in claim 1, further including:

providing internally of the winding core a spool body for reception of the winding band; and providing at the winding core an opening for the removal of the winding band from the spool body.

6. The method as defined in claim 5, further including the step of:

arranging the spool body substantially coaxially with respect to the winding core.

7. The method as defined in claim 5, further including the step of:

arranging the spool body substantially parallel to the winding core.

8. The method as defined in claim 5, further including the step of:

providing a cover for closing the opening provided in the winding core.

9. A method of using a flexible band and utilizing a hook and loop fastener, said hook and loop fastener comprising a first fastener portion provided with a fastener pile, a second fastener portion provided with a fastener pile, said first and second fastener portions providing a separable fastening connection therebetween by means of said fastener piles, compression-resistant spacer means provided for each fastener portion and arranged adjacent the fastener pile of each said fastener portion, each of said spacer means having a predetermined thickness, each of said fastener piles having a predetermined height, the predetermined thickness of each of said spacer means at most corresponding to the predetermined height of the fastener pile of the associated fastener portion, said flexible band having a lengthwise direction, opposed end regions and opposite sides, one of said fastener portion, said flexible band having a lengthwise direction, opposed end regions and opposite sides, one of said fastener portions being secured to a winding core, the other of said fastener portions being secured to one of the end regions of said flexible band at one side thereof, further first and second fastener portions secured at the other end region of the flexible band on opposite sides thereof and in spaced relationship from one another, said further fastener portions being provided with compression-resistant spacer means, said compression-resistant spacer means of each of said fastener portions and said further fastener portions comprising flexible spacer means, said method comprising the steps of:

employing said flexible band as a winding band which is wound between winding coils of substantially flat structures which are to be wound up upon the winding core to form a product package from which the flexible band and the flat structures are unwound; and releasably connecting the winding band to the winding core, and including pressing said other of said fastener portions into contact with said one of said fastener portions.

10. The method as defined in claim 9 wherein another of said fastener portions is secured to said other side of said flexible band and in spaced relationship from said other of said fastener portions.

11. The method as defined in claim 9, wherein:

an end region of the winding band located remote from the winding core carries at a side of the winding band which confronts the winding core one of the further fastener portions and in spaced relationship therefrom at the side of the winding band which faces away from the winding core the other one of the further fastener portions, so that the winding band after accomplishing at least one additional wrapping about the wound product package is fixedly releasably secured to itself about the wound product package.

12. The method as defined in claim 11, further including the steps of:

applying a substantially flat tool at an end of the winding band located remote from the winding core;

said substantially flat tool being applied between mutually contacting spacer means of the further fastener portions; and moving in relation to one another the tool and an outer surface of the wound product package in a predetermined product unwinding direction in order to release the further fastener portions from engagement with one another.

13. The method as defined in claim 9, further including:

providing internally of the winding core a spool body for reception of the winding band; and providing at the winding core an opening for the removal of the winding band from the spool body.

14. The method as defined in claim 13, further including the step of:

arranging the spool body substantially coaxially with respect to the winding core.

15. The method as defined in claim 13, further including the step of:

arranging the spool body substantially parallel to the winding core.

16. The method as defined in claim 13, further including the step of:

providing a cover for closing the opening provided in the winding core.

* * * * *

UNITED STATES PATENT AND TRADEMARK OFFICE

CERTIFICATE OF CORRECTION

PATENT NO. : 5,105,520

DATED : April 21, 1992

INVENTOR(S) : Jürg Eberle

It is certified that error appears in the above-identified patent and that said Letters Patent is hereby corrected as shown below:

In the Claims:

Column 11, lines 4-6, please delete "one of said fastener portion, said flexible band having a lengthwise direction, opposed end regions and opposite sides".

Signed and Sealed this

Twenty-first Day of September, 1993

Bruce Lehman

*Attest:*

BRUCE LEHMAN

*Attesting Officer*

*Commissioner of Patents and Trademarks*